US008196622B1

(12) United States Patent
Fisher

(10) Patent No.: US 8,196,622 B1
(45) Date of Patent: Jun. 12, 2012

(54) APPARATUS FOR RECEIVING AND DISPENSING GRANULATED MATERIALS

(76) Inventor: Michael A. Fisher, Wichita, KS (US)

( * ) Notice: Subject to any disclaimer, the term of this patent is extended or adjusted under 35 U.S.C. 154(b) by 868 days.

(21) Appl. No.: 12/275,124

(22) Filed: Nov. 20, 2008

(51) Int. Cl.
*B65B 1/04* (2006.01)

(52) U.S. Cl. ..... 141/384; 141/330; 141/332; 141/383

(58) Field of Classification Search ..... 141/331, 141/332, 340, 344, 345, 231, 232, 233, 311 R, 141/383, 384, 330; 222/80–91
See application file for complete search history.

(56) References Cited

U.S. PATENT DOCUMENTS

| | | | | | |
|---|---|---|---|---|---|
| 959,715 | A | * | 5/1910 | Carson | 141/340 |
| 2,058,925 | A | * | 10/1936 | Tompkins | 141/330 |
| 2,071,944 | A | * | 2/1937 | Hoffman | 222/88 |
| 2,281,727 | A | * | 5/1942 | Stewart | 141/18 |
| 3,156,369 | A | * | 11/1964 | Bowes et al. | 206/222 |
| 5,074,343 | A | * | 12/1991 | Tyree, Jr. | 141/300 |
| 5,074,824 | A | | 12/1991 | Suris | |
| 5,131,566 | A | * | 7/1992 | Bavegems | 222/80 |
| 5,228,488 | A | * | 7/1993 | Fletcher | 141/331 |
| 5,287,993 | A | * | 2/1994 | Ford et al. | 222/135 |
| 5,405,053 | A | * | 4/1995 | Zublin | 222/83.5 |
| 5,551,606 | A | * | 9/1996 | Rai et al. | 222/460 |
| 5,685,351 | A | * | 11/1997 | Kazarian et al. | 141/325 |
| 5,862,120 | A | * | 1/1999 | Mukawa | 720/707 |
| 5,927,353 | A | * | 7/1999 | Persson et al. | 141/340 |
| 5,967,201 | A | * | 10/1999 | Gasior | 141/98 |
| 6,000,446 | A | * | 12/1999 | Wegman et al. | 141/131 |
| 6,116,299 | A | * | 9/2000 | Cummins et al. | 141/332 |
| D432,915 | S | * | 10/2000 | Smith | D9/436 |
| 6,223,792 | B1 | * | 5/2001 | Slagle | 141/331 |
| 6,425,424 | B1 | * | 7/2002 | Ellis Calvo et al. | 141/331 |
| 6,565,024 | B2 | | 5/2003 | Getzmann | |
| 6,715,640 | B2 | | 4/2004 | Tapphorn | |
| 6,994,129 | B2 | * | 2/2006 | Fesko | 141/330 |
| 7,055,685 | B1 | * | 6/2006 | Patterson et al. | 206/220 |
| 7,070,046 | B2 | | 7/2006 | Cho | |
| 7,284,581 | B2 | * | 10/2007 | Steinweg | 141/340 |
| 2004/0007189 | A1 | * | 1/2004 | Betty et al. | 119/57.92 |
| 2006/0278642 | A1 | * | 12/2006 | Pugne et al. | 220/256.1 |
| 2007/0187296 | A1 | | 8/2007 | Pardini | |
| 2008/0067084 | A1 | | 3/2008 | Patterson et al. | |

FOREIGN PATENT DOCUMENTS

| | | |
|---|---|---|
| EP | 0076224 | 6/1983 |
| JP | 2004210371 | 7/2004 |
| WO | WO2008/019836 | 2/2008 |

* cited by examiner

*Primary Examiner* — Timothy L Maust
(74) *Attorney, Agent, or Firm* — Kenneth H. Jack; Davis & Jack, L.L.C.

(57) ABSTRACT

An apparatus for receiving and dispensing a granulated material incorporating a hopper; a coupling member having an upper end, a lower end, and a conduit extending from the upper end to the lower end; a snap channel and snap ridge combination for rotatably interconnecting the hopper and the coupling member, the snap channel and snap ridge combination positioning the coupling member for communication of the conduit with a lower output end of the hopper; an agitator having proximal and distal ends, the agitator's proximal end being fixedly attached to the coupling member, the agitator's distal end extending into the hopper's interior space; and a bottle mounting socket fixedly attached to the coupling member's lower end.

13 Claims, 8 Drawing Sheets

APPARATUS FOR RECEIVING AND DISPENSING GRANULATED MATERIALS

FIELD OF THE INVENTION

This invention relates to hoppers or funnels adapted for receiving granulated or powdered material and for downwardly channeling and dispensing such material through a narrowed output end.

BACKGROUND OF THE INVENTION

Weight lifters and other persons engaged in athletic training commonly mix granulated or powdered protein supplements and water within a common commercially sold water bottle. In order to perform such supplement mixing, the athlete is typically required to transfer the protein supplement material from a storage canister into the water bottle. Such materials transfer is often difficult to accomplish due to factors such as the typically narrow bore of the mouths of commonly sold water bottles, and a common tendency of protein supplement mixes to clump and coagulate.

A commonly known means for assisting in transferring such granulated protein mix into a water bottle utilizes a common funnel whose throat or output end is inserted into the upwardly opening mouth of the water bottle. However, utilization of such funnel means typically narrows the bore through which the granulated protein supplement mix must pass, such narrowing aggravating the mix's coagulation or clumping tendency and further hampering or interrupting the desired downward flow of the protein supplement mix. In order to overcome such flow disrupting coagulation and clumping of the protein mix within such common funnel, athletes are known to utilize an agitator such as a stir stick to break up protein mix coagulations and clumps within the funnel's bell, and to urge the protein mix to flow downwardly through the funnel's throat and into the water bottle. However, such method undesirably requires the athlete to locate and to provide a clean stirring utensil, which often is not readily found within gyms and workout rooms. Upon finding a suitable stirring utensil, use of such common funnel transfer means further undesirably requires the athlete to unergonomically simultaneously handle and manipulate three articles, they being the funnel, the mixing bottle, and the stirring utensil.

The instant inventive apparatus for receiving and dispensing granulated materials solves or ameliorates the problems and disadvantages of commonly used mixing bottle, funnel and stirring utensil combinations discussed above by providing a specially adapted and configured funnel which incorporates a rotatable coupling member, such member being adapted to include and extend an agitator into the bell of a funnel, and such member being adapted to both facilitate releasable attachment of the funnel to a mixing bottle, and facilitate rotation of the bottle, the coupling member and the agitator with respect to the funnel.

BRIEF SUMMARY OF THE INVENTION

A first structural component of the instant inventive apparatus for receiving and dispensing granulated material (preferably protein supplement mixes) comprises a hopper having a flared upper intake end, a narrowed lower output end or throat, and an interior space. Preferably, the hopper is configured in the manner of a belled funnel having an interior which comprises an interior wall which defines an upwardly flaring and downwardly narrowing conical concavity. The hopper, and all other components of the instant invention, preferably comprise molded plastic.

A further structural component of the instant inventive apparatus comprises a coupling member having an upper end, a lower end, and a conduit or hollow bore extending from the coupling member's upper end to its lower end. The coupling member preferably is configured substantially cylindrically, and the outside diameter of the upper end of the coupling member is preferably fitted for sliding receipt within the inside diameter of the hopper's throat.

A further structural component of the instant inventive apparatus comprises rotatable mounting means which are adapted for interconnecting the hopper and the coupling member. Preferably, the rotatable mounting means comprises an annular snap channel and snap ridge combination which releasably interconnects the hopper's lower output end or throat and the upper end of the coupling member. Preferably, such channel and ridge combination is loosely fitted for facilitating rotation of the hopper and coupling member with respect to each other, and for detachment of those two components from each other for separate cleaning. Other commonly known rotatable mounting means such as plain bearing surfaces, or bearing surfaces in combination with a plain extraction stop, may be suitably substituted for the preferred annular snap ridge and snap channel combination.

A further structural component of the instant inventive apparatus comprises an agitator having proximal and distal ends, the proximal end of the agitator being fixedly attached to the coupling member to form an agitator and coupling member combination. The agitator is preferably positioned to extend from the coupling member's upper end so that, upon rotatable mounting of the coupling member upon the hopper's throat, the agitator extends into the hopper's interior space.

A further structural component of the instant inventive apparatus comprises bottle mounting means, such means preferably being fixedly attached to the lower end of the coupling member. Preferably, the bottle mounting means comprises a helically threaded socket, such socket being fitted for threaded engagement with the typically helically threaded mouths of commonly commercially sold water bottles. Other commonly known mounting means such as pressure fitted joints or annularly clamped joints may be suitably substituted for the preferred helically threaded socket bottle mounting means.

In order to accommodate for varying sizes and diameters of helically threaded mouths of commonly commercially sold water bottles, the instant inventive apparatus preferably provides a plurality of coupling member and agitator combinations, the upper end of the coupling member of each such combination preferably being configured substantially identically with each other coupling member's upper end, such identity of structures allowing several differently sized agitator and coupling member combinations to be used with a single hopper component. Preferably, the lower ends of the coupling members of such combinations are varyingly fitted to include helically threaded sockets sized for threaded engagements with the helically threaded mouths of such variously sized water bottles.

In use of the instant inventive apparatus for receiving and dispensing granulated material, and assuming the provision of preferred structures and components described above, an athlete may initially cause an appropriately sized agitator and coupling member combination to be rotatably mounted upon the output end or throat of the hopper. In such assembly, the agitator is preferably extended upwardly into the lower opening of the hopper prior to final snap fitting of the components. Thereafter, the athlete may partially fill a water bottle with water, and the athlete may threadedly screw the lower socket end of the coupling member over the water bottle's mouth. Thereafter, the athlete may pour a quantity of granulated or powdered protein supplement mix into the hopper's upwardly opening conical concavity. Thereafter, the athlete may hold the hopper in one hand while holding the bottle in the other hand, and may cause the hopper and the bottle to be repeatedly rotated and counter-rotated with respect to each other. During such rotating and counter-rotating movement, the ridge of the snap ridge and channel combination remains retained within and is guided by the channel, such retention securely holding the hopper upon the coupling member and upon the bottle during such rotating movement. Also, upon such rotation and counter-rotation, the agitator moves in circular arcs, rotating and counter-rotating within the hopper's interior. Such agitator motion causes the agitator to impinge against any clumps or coagulated portions of the protein supplement mix within the hopper's interior, and beneficially causes such material to freely flow downwardly through the hopper's throat and into the interior of the water bottle for mixing.

Upon completion of such usage steps, the hopper and the agitator and coupling member combination may be detached from each other in order to expose all joint or contact surfaces for cleaning.

Accordingly, objects of the instant invention include the provision of an apparatus for receiving and dispensing granulated material which incorporates structures, as described above, and which arranges such structures for the performance of beneficial functions, as described above.

Other and further objects, benefits, and advantages of the present invention will become known to those skilled in the art upon review of the Detailed Description which follows, and upon review of the appended drawings.

DETAILED DESCRIPTION OF A PREFERRED EMBODIMENT

Figure 1:
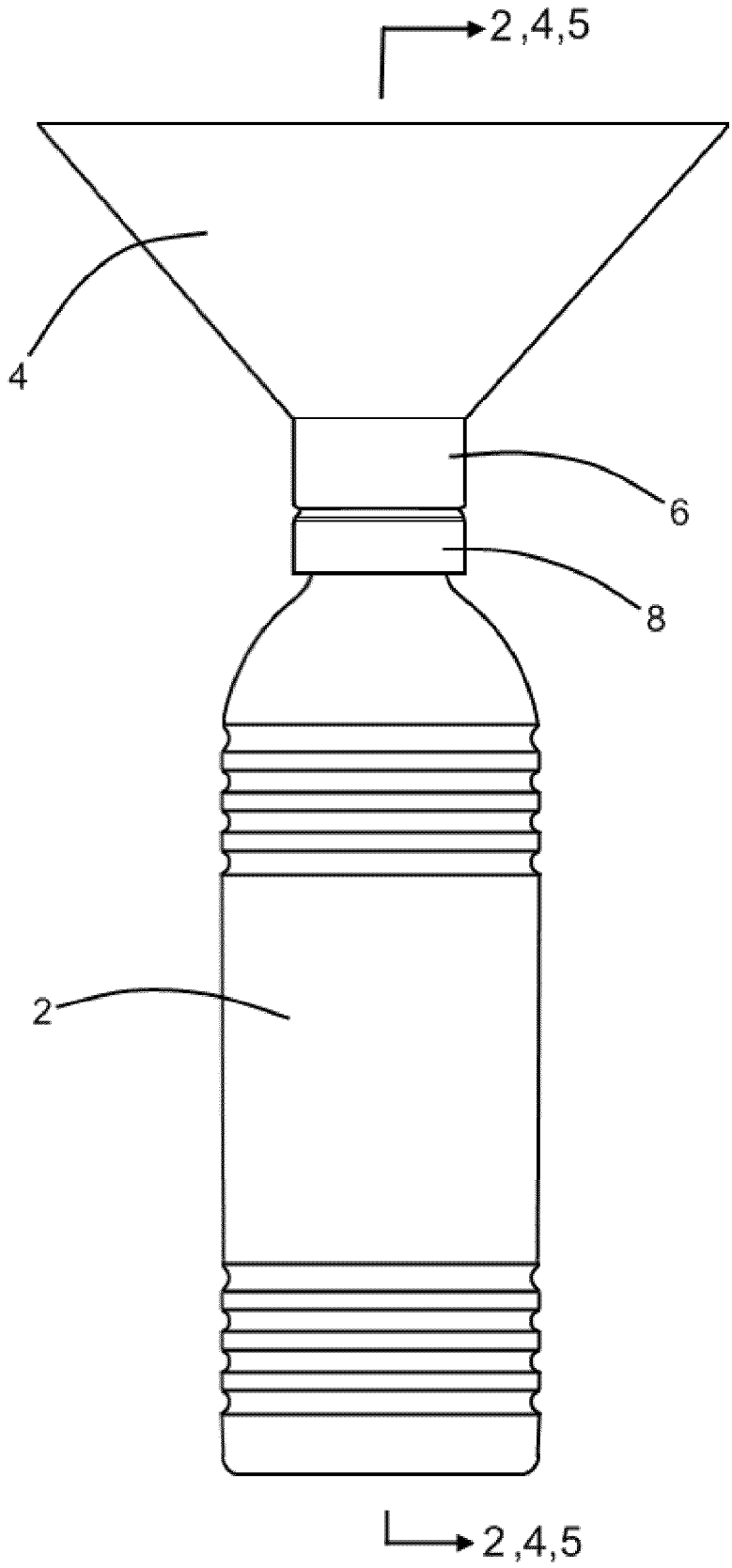
FIG. 1 is a side view of the instant inventive apparatus for receiving and dispensing granulated material.
Figure 2:
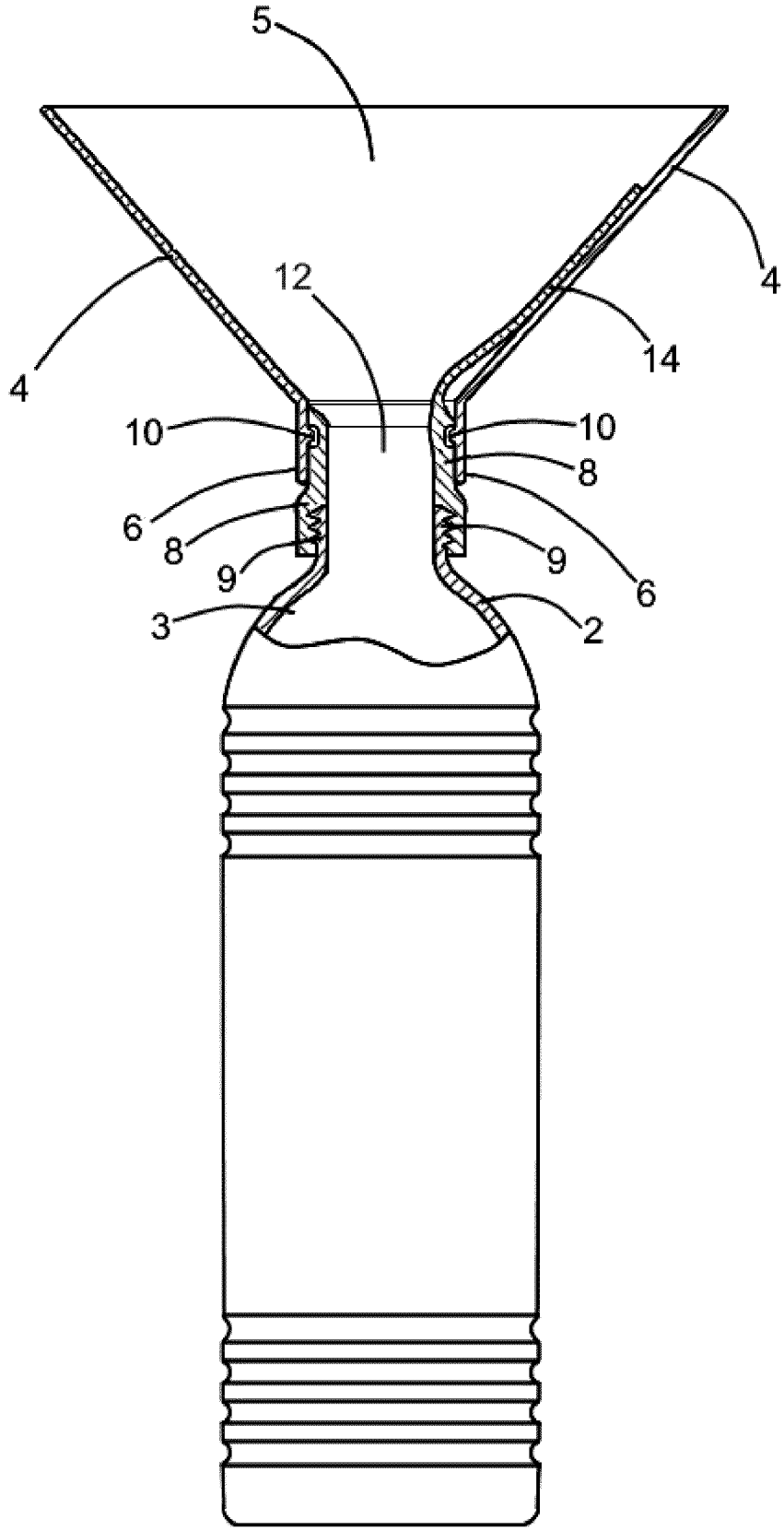
FIG. 2 is a sectional view as indicated in FIG. 1.
Figure 3:
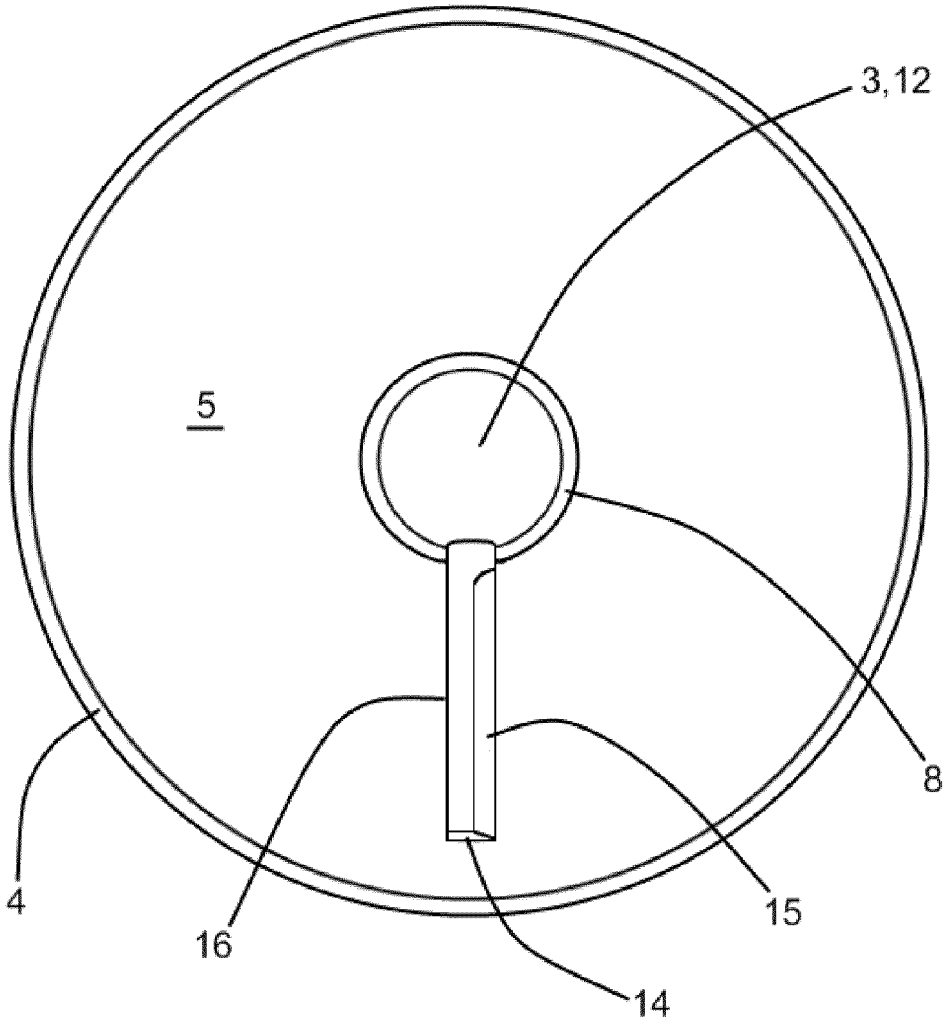
FIG. 3 is an upper view of the apparatus depicted in FIG. 1.

Referring now to the drawings, and in particular to FIG. 1, the instant inventive apparatus for receiving and dispensing granulated material comprises a hopper or funnel 4 having a lower output end or throat 6. Referring further simultaneously to FIG. 2, the hopper 4 has a conically walled interior space 5, and the lower output end 6 of the hopper 4 presents an annular inwardly extending snap ridge 10.

Figure 5:
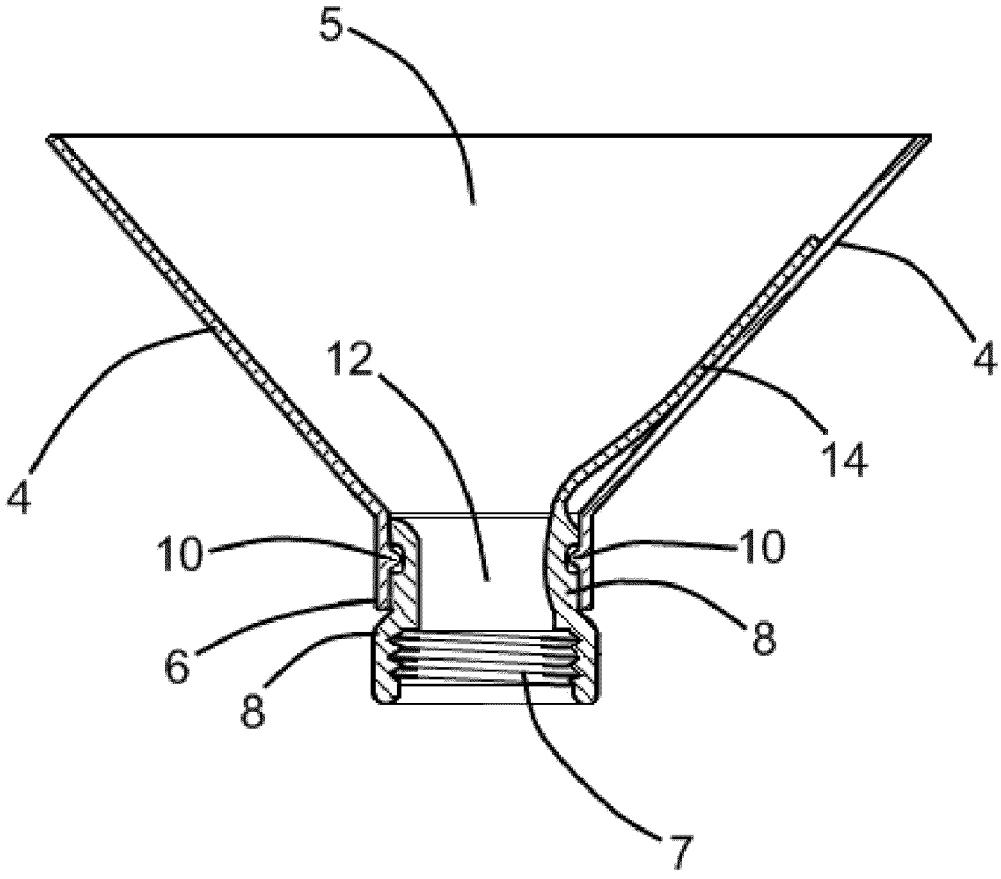
FIG. 5 is an alternative sectional view as indicated in FIG. 1, the view of FIG. 5 showing a mixing bottle component removed.

Referring simultaneously to FIGS. 1 and 5, at least a first agitator 14 and coupling member 8 combination is provided, the coupling member 8 of such combination having a conduit 12 which extends from its upper end to the lower end. The lower end of the coupling member 8 and the lower end of the conduit 12 are configured to function as bottle attaching means, which preferably comprises a helically threaded bottle mouth receiving socket 7.

Figure 6:
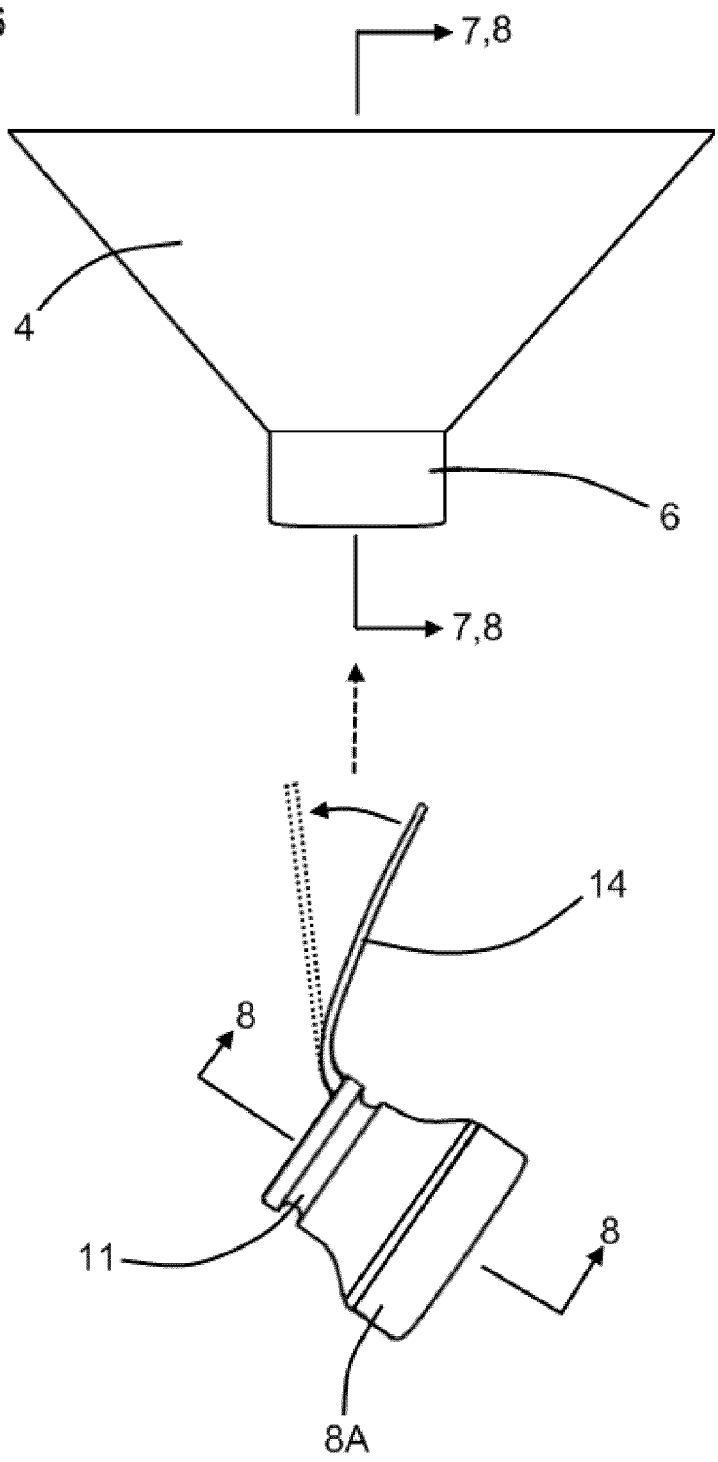
FIG. 6 is an exploded view of components of the instant invention.

Referring simultaneously to FIGS. 1, 5, and 6, the drawn figures of the invention depict the hopper's throat 6 receiving the upper end of the coupling member 8, and depict an inwardly extending snap ridge 10 received within an outwardly opening snap channel 11. Receipt of the coupling member 8 within the throat 6 is preferred because, in such configuration, the agitator 14 is easily extended from the upper end of the coupling member 8 into the interior 5 of the hopper 4. Also, the outwardly opening ridge receiving channel 11 is preferred over an alternative (and not depicted) inwardly opening channel extending into the wall of the throat (or into the wall of the coupling member's conduit, as the case may be) because outwardly opening channels are easily cleaned. In contrast, inwardly opening channels within bore walls tend to undesirably shield debris from cleaning. Notwithstanding, the depicted throat and coupling member arrangement and the depicted snap channel and snap ridge arrangement are intended as being representative of their inverse mechanical configurations (i.e., the throat alternatively received within the coupling member's upper opening and/or an inwardly opening snap channel alternatively receiving an outwardly extending snap ridge).

Referring simultaneously to FIGS. 2, 3, 5, and 6, the agitator 14 is preferably fixedly attached to the coupling member 8 via plastic molding as an integral unit, such agitator 14 preferably extending upwardly from the coupling member's upper lip. As is particularly depicted in FIG. 6, such molding preferably orients the agitator 14 so that it normally angularly extends outwardly beyond the slope of the hopper's wall. As a result of such molded configuration, and upon rotatable connection of the coupling member 8 to the output 6 of the hopper 4, the agitator 14 advantageously flexibly biases outwardly in the manner of a leaf spring against the interior wall surface of the hopper 4. Such biasing contact advantageously causes the agitator 14 to further function as a wall surface wiping element. As is particularly shown in FIG. 3, the agitator 14 is preferably configured to include a beveled edge 15 and a blunt or approximately 90° angled edge 16, the beveled edge 15 effectively wiping and skimming material from the surface of the wall of the hopper 4 upon rotation of the agitator 14, and the blunt edge 16 effectively impinging against and breaking up material within the hopper upon counter-rotation.

Figure 4:
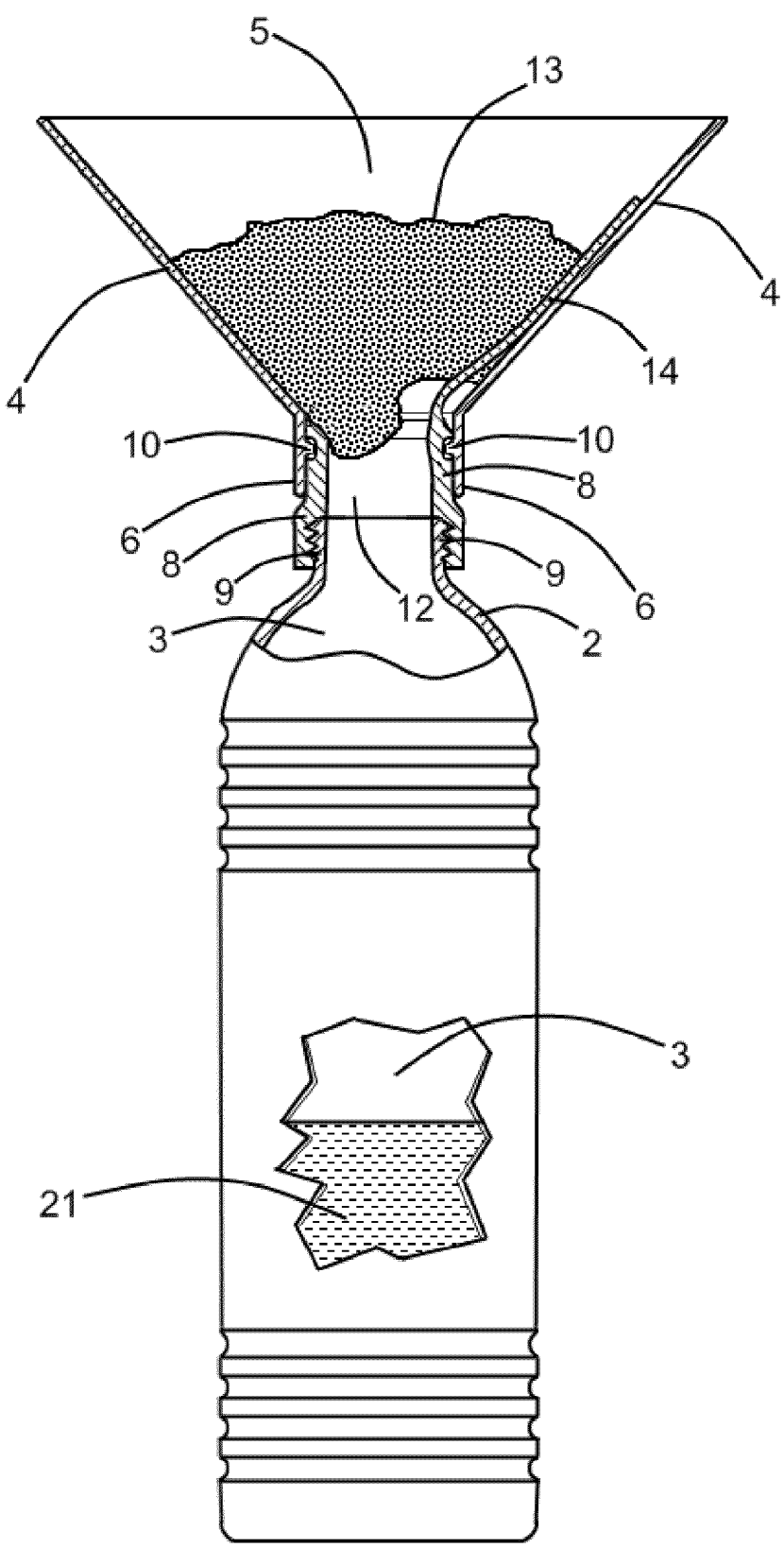
FIG. 4 redepicts FIG. 2, the view of FIG. 4 additionally showing granulated protein mix and water within the apparatus.
Figure 7:
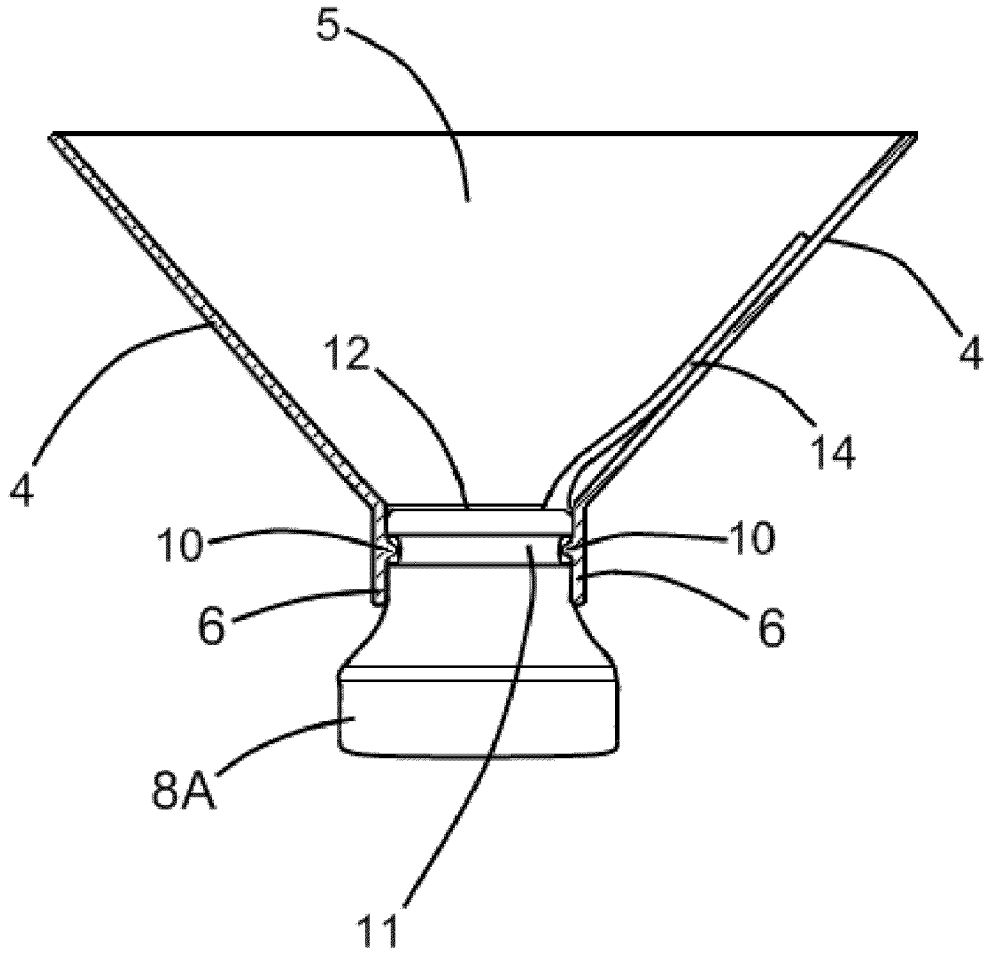
FIG. 7 is an assembled and partially sectional view as indicated in FIG. 6.

In use of the instant invention, referring in particular to FIG. 4, a common water bottle 2 may be initially provided for use as a mixing vessel, the water bottle 2 having an interior space 3 and a helically threaded mouth 9. An athlete utilizing the instant inventive apparatus may initially partially fill the interior 3 of the bottle 2 with water 21. Referring further to FIGS. 6 and 7, the athlete may thereafter, or suitably preliminarily, grasp in either hand the hopper 4 and the coupling member 8, and may interconnect those two components in the configuration depicted in FIG. 7. In the assembled configuration of FIG. 7, the snap ridge 10 and snap channel 11 combination effectively rotatably mounts the coupling member 8 upon the hopper 4, while the agitator 14 extends into the interior 5 of the hopper 4 for materials agitation and for hopper wall wiping.

Referring simultaneously to FIGS. 4 and 5, the athlete may thereafter, or suitably preliminarily, affix the lower end of the coupling member 8 to the bottle 2 via engagement of female threads 7 with male threads 9. Such engagement securely and releasably mounts both the hopper 4 and the coupling member 8 upon the bottle 2.

Thereafter, the athlete may pour a quantity of powdered or granulated protein supplement mix 13 into the interior 5 of the hopper 4, such material 13 commonly clumping and coagulating without freely flowing downwardly into the bottle 2 through the conduit 12 of the coupling member 8. Thereafter, the athlete may grasp the hopper 4 in one hand while grasping the bottle 2 in the other hand, and may repeatedly rotate and counter-rotate those two components with respect to each other. Upon such rotation and counter-rotation, the agitator 14 arcuately moves rotatably and counter-rotatably within the interior 5 of the hopper 4, wiping the inner wall of the hopper 4 upon rotation, and impinging against and breaking up the protein powder mix 13 upon counter-rotation. Such agitating impingement and wall wiping actions cause the protein powder mix 13 to freely flow downwardly through the conduit 12 into the interior 3 of the bottle 2 for mixing with the water 21.

Figure 8:
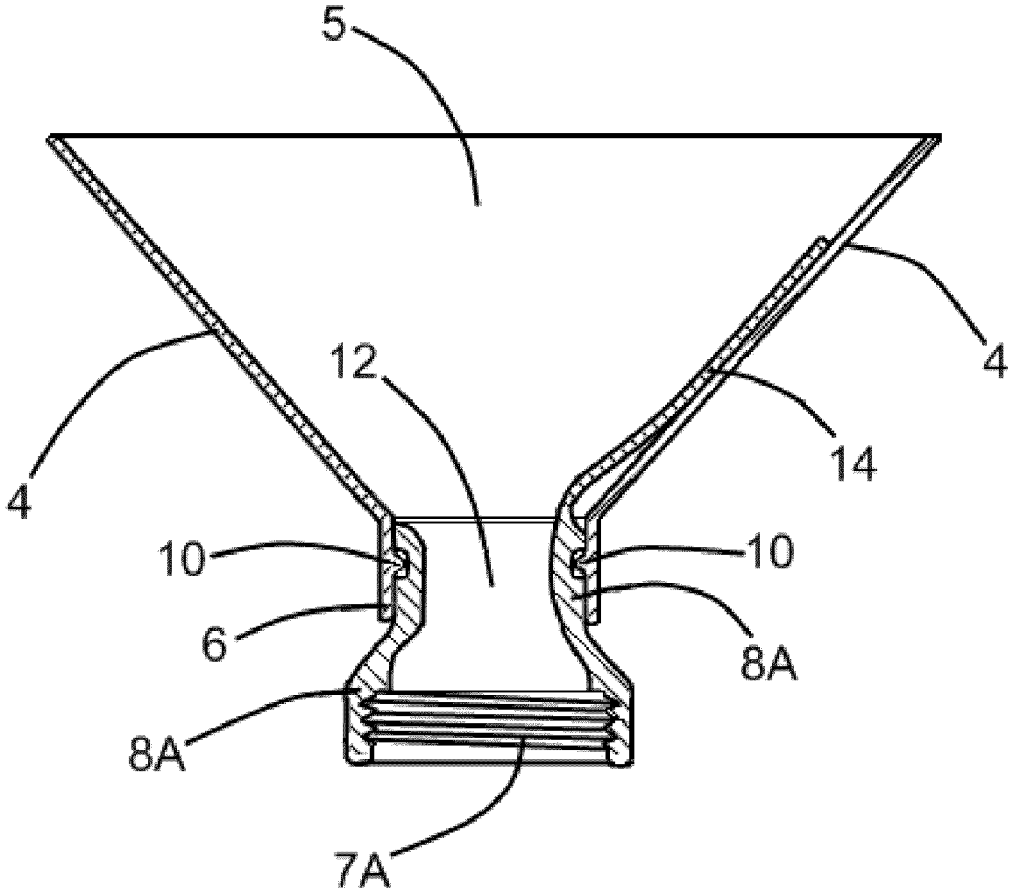
FIG. 8 is an assembled and sectional view as indicated in FIG. 6.

Referring simultaneously to FIGS. 5, 6, and 7, it may be seen that the threaded bottle mounting means 7A, depicted in FIG. 8, is wider than the threaded bottle mounting means 7, depicted in FIG. 5. Such variation in the inside diameters of the bottle coupling member's bottle mounting means constitutes a preferred adaptation of the instant invention which enables the apparatus to accommodate multiple water bottle types whose mouths have differently sized outside diameters. In such adaptation, the instant invention preferably provides a plurality of differently sized coupling members, such plurality being represented by the narrow bottle mouth accommodating coupling member 8 depicted in FIG. 5, and the wider bottle mouth accommodating coupling member 8A depicted in FIG. 7. The upper end of each coupling member among such plurality of coupling members is preferably configured substantially identically with that of each other coupling member, such identity of upper structures allowing several differently sized coupling members to be interchangeably attached to a single hopper component.

After use of the instant invention for protein supplement mixing, as discussed above, the coupling member and hopper components may be advantageously detached in order to expose all joint and contact surfaces for easy cleaning and sanitation.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. An apparatus for receiving and dispensing a granulated material, the apparatus comprising:

(a) a hopper having a conical interior space, an upper intake end, a lower output end, and an interior space bounded by an inner wall;

(b) a coupling member having an upper end, a lower end, and a conduit extending from said upper end to said lower end;

(c) rotatable mounting means interconnecting the hopper and the coupling member, the rotatable mounting means positioning the coupling member for communication of the conduit with the hopper's lower output end;

(d) an agitator having proximal and distal ends, the agitator's proximal end being fixedly attached to the coupling member, the agitator's distal end extending into the hopper's interior space; and (e) bottle mounting means fixedly attached to the coupling member's lower end; the agitator being positioned for rotatably wiping the hopper's inner wall.

2. The apparatus of claim 1 wherein the agitator is configured to present a beveled edge.

3. The apparatus of claim 2 wherein the agitator is further configured to present a blunt edge, the blunt edge being positioned oppositely from the beveled edge.

4. The apparatus of claim 1 wherein the rotatable mounting means comprises an annular channel.

5. The apparatus of claim 4 wherein the rotatable mounting means further comprises an annular ridge, the annular channel being fitted for removable receipt of the annular ridge.

6. The apparatus of claim 1 wherein the bottle mounting means comprises a helically threaded socket.

7. The apparatus of claim 6 further comprising a mixing bottle having a mouth, the mixing bottle's mouth being threadedly attachable to the helically threaded socket.

8. An apparatus for receiving and dispensing a granulated material, the apparatus comprising:

(a) a hopper having an upper intake end, a lower output end, and an interior space, the interior space comprising an interior wall defining a conical concavity;

(b) a plurality of agitator and coupling member combinations, each such combination's coupling member having an upper end, a lower end, and a conduit extending from the upper end to the lower end, each such combination's agitator having a proximal end and distal end, the proximal end being fixedly attached to said each combination's coupling member;

(c) rotatable mounting means adapted for interchangeably interconnecting the agitator and coupling member combinations and the hopper, the rotatable mounting means, upon connection of one of the agitator and coupling member combinations to the hopper, positioning said one combination's conduit for communication with the hopper's lower output end, and extending said one combination's agitator into the hopper's interior space; and (d) a plurality of bottle attachment helically threaded sockets, each bottle attachment helically threaded socket being fixedly attached to the lower end of a coupling member among the agitator and coupling member combinations, each bottle attachment socket having an inside diameter varying from that of each other bottle attachment socket; wherein, upon the connection of said one of the agitator and coupling member combinations to the hopper, said one combination's agitator further extends for wiping contact against the hopper's interior wall.

9. The apparatus of claim 8 wherein each agitator is configured to present a beveled edge.

10. The apparatus of claim 9 wherein each agitator is further configured to present a blunt edge, the blunt edge being positioned oppositely from said each agitator's beveled edge.

11. The apparatus of claim 8 wherein the rotatable mounting means comprises a plurality of annular channels, each annular channel being positioned at the upper end of one of the coupling members.

12. The apparatus of claim 11 wherein the rotatable mounting means further comprises an annular ridge positioned at the hopper's output end, each annular channel being fitted for removable receipt of the annular ridge.

13. The assembly of claim 8 further comprising a plurality of mixing bottles, each mixing bottle having a mouth, each mouth being threadedly attachable to one of the coupling members' helically threaded sockets.

* * * * *